US006431181B1

(12) United States Patent
Torres

(10) Patent No.: US 6,431,181 B1
(45) Date of Patent: Aug. 13, 2002

(54) HAIR COLORING CAP AND METHOD OF USE

(76) Inventor: Ana Maria Torres, 3821 W. Franklin Ave. #6, Fullerton, CA (US) 92833

( * ) Notice: Subject to any disclaimer, the term of this patent is extended or adjusted under 35 U.S.C. 154(b) by 0 days.

(21) Appl. No.: 09/542,671

(22) Filed: Apr. 4, 2000

(51) Int. Cl.[7] ..... A41G 5/00; A61K 7/13; A45D 19/18

(52) U.S. Cl. ..... 132/270; 132/208; 132/54

(58) Field of Search ..... 132/270, 54, 212, 132/208, 222, 53, 56

(56) References Cited

U.S. PATENT DOCUMENTS 3,304,945 A * 2/1967 Anderson ..... 132/54
3,586,009 A * 6/1971 Sirmons ..... 132/54
4,165,754 A * 8/1979 Di Pasque ..... 132/54
4,750,500 A * 6/1988 Allen ..... 132/270
5,042,511 A * 8/1991 Haddad ..... 132/208
5,562,111 A 10/1996 Torres ..... 132/270
5,979,462 A * 11/1999 Jones ..... 132/54
5,988,177 A * 11/1999 Bate ..... 132/54

* cited by examiner

*Primary Examiner*—John J. Wilson
*Assistant Examiner*—Robyn Kieu Doan
(74) *Attorney, Agent, or Firm*—Eric Karich

(57) ABSTRACT

A hair coloring cap, for use in selectively changing the color of multiple strands of hair on a head of a user, includes a support frame for supporting a plurality of strut members in a spaced apart positions around the head of the user. Each of a plurality of wing members are attached to one of the plurality of strut members and extends therefrom to a length approximately that of the multiple strands of hair to be colored. The cap is positioned on the head and multiple strands of hair are pulled between the strut members so that the hair is positioned on an upper surface of each of the plurality of wing members. A coloring agent is applied to the upper surface of each of the plurality of wing members, such that the coloring agent functionally coats each of the multiple strands of hair to be colored. Each of the plurality of wing members is then folded, thereby trapping the hair and the coloring agent.

3 Claims, 2 Drawing Sheets

HAIR COLORING CAP AND METHOD OF USE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to hair coloring devices, and more particularly to a hair coloring cap for use in selectively changing the color of multiple strands of hair of a user.

2. Description of Related Art

In the hairdressing art it is often desired to cause the hair to exhibit two colors, a process called by several names such as coloring, tinting, frosting, or highlighting. This invention comprises a novel and useful cap to be used by the hairdresser to expedite the process of coloring localized strands or bunches of hair in an orderly pattern so as to enhance the overall effect on an observer of hair which has been subjected to localized re-coloring.

There are three caps currently used for what hairdressers call highlighting or frosting, to assist the hairdresser in producing the desired effect.

One product is a full cap to be tightly fitted over all the area from which hair grows. Holes are provided essentially all over the surface of the cap, which is placed over combed-back hair. The strands to be colored are drawn through the holes with a tiny hook inserted in each hole, capturing a tiny lock of hair which is then pulled through the cap and becomes the strand to be colored. This type of cap allows the treating chemical to be applied at the same time, approximately, to all the strands to be colored—avoiding both under-coloring and excessive exposure to the chemical which can damage the hair. It's principal disadvantage is that the strands pulled through the cap need not extend to their roots. Depending on the time, patience and skill of the hairdresser's blind manipulation of the tiny hook, the hair pulled through can come from any depth and/or a location on the scalp dependent on the parallelism of individual hairs generated by the pre-combing and, in theory, retained during installation of the cap. Hairs from an upper layer might originate an inch or more distant from the hole, or a smaller distance sideways. Moreover, backsliding the length of a strand of hair against the combed direction of adjacent hairs may disturb the orderliness of hair "downstream" from the hole being worked on. The result in any case is some discomfort to the customer, more discomfort and disorderliness than my invention provides.

Another device for doing the same localized strand-coloring is a stack of special-purpose self-adhesive wraps in the form of sheets and a "helper," a rectangular flat made of plastic on which one sheet is to be laid for each line of strands to be colored. A substantially horizontal line is created in the hair mass, with the helper's narrow end close to the scalp and the hair above temporarily directed upward except for the strands to be treated, which lie in the long direction of the helper on which one sheet of the self-adhesive wrap lies. The chemical is applied, the wrap doubled over enclosing chemical and hair strands and sealed to itself, and the helper removed. The entire process is then repeated a fraction of an inch higher on the head, and again and again to cover the back and sides of the head. The duration of manipulation is a serious drawback to this method, since exposure of hair strands to chemical varies so much at various placed on the head. It is a slow process with considerable danger of over-processing or under-coloring local regions. Damage to the hair, or variability of result over the head are the principal drawbacks to the use of wraps to color hair locally. My invention accomplishes the same end without such drawbacks, as the hair preparation time is divorced from the time span in which the hair is exposed to chemicals.

The third device is a one-piece cap to go on a head of hair to be partially re-colored in isolated strands. The cap covers the head in the manner of a bathing cap. The cap includes a framework of support bands which divide the head into roughly rectangular zones which are independent and can be treated one by one. Spanning from side to side of the roughly rectangular zones are narrow strut members carrying wing members. Both have a row of perforations along the length direction; both are of chemical-resistant plastic. The strut members are narrow and thin ribbons spaced roughly parallel to each other, attached at their ends to framework members. The wing members are attached to the strut members and consist of double sheets of thin plastic film on which, between the doubled sheets, the hair strands to be colored lie (separated and isolated from the rest of the hair). These strands are pulled through the perforations and lie between the halves of one folded wing, ready for application of the chemical to the strands alone. The hairdresser uses a comb with short teeth to reach between strut members and part the hair beneath each strut member, one part at a time, to ensure all chemical reaches as close as feasible to the hair roots.

The prior art teaches caps that are useful for facilitating the process of highlighting or coloring a person's hair. However, the prior art does not teach a hair coloring cap that allows the hair to be separated into multiple sections and spread upon an upper surface of a plurality of wing members, the wing members being foldable to contain a coloring agent with the hair. The present invention fulfills these needs and provides further related advantages as described in the following summary.

SUMMARY OF THE INVENTION

The present invention teaches certain benefits in construction and use which give rise to the objectives described below.

The present invention provides a cap for use in selectively changing the color of multiple strands of hair on a head of a user. The cap includes a support frame means for supporting a plurality of strut members in a spaced apart positions around the head of the user. Each of a plurality of wing members are attached to one of the plurality of strut members and extends therefrom to a length approximately that of the multiple strands of hair to be colored. The cap is positioned on a head of the user and multiple strands of hair to be colored are pulled between the strut members so that the hair is positioned on an upper surface of each of the plurality of wing members. A coloring agent is applied to the upper surface of each of the plurality of wing members and the wing member is folded, thereby trapping the hair and the coloring agent within each of the plurality of wing members such that the coloring agent functionally coats each of the multiple strands of hair to be colored.

A primary objective of the present invention is to provide a hair coloring cap having advantages not taught by the prior art.

Another objective is to provide a hair coloring cap that allows the hair to be separated quickly and easily, without requiring the hair to be pulled through small holes or perforations in the cap.

A further objective is to provide a cap having a plurality of wing members, each of the wing members being shaped to contain the coloring agent to prevent the unwanted transfer of the coloring agent to other surfaces.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a cap 10 for use in changing the color of multiple strands of hair 12 on a head of a user 11.

Figure 1:
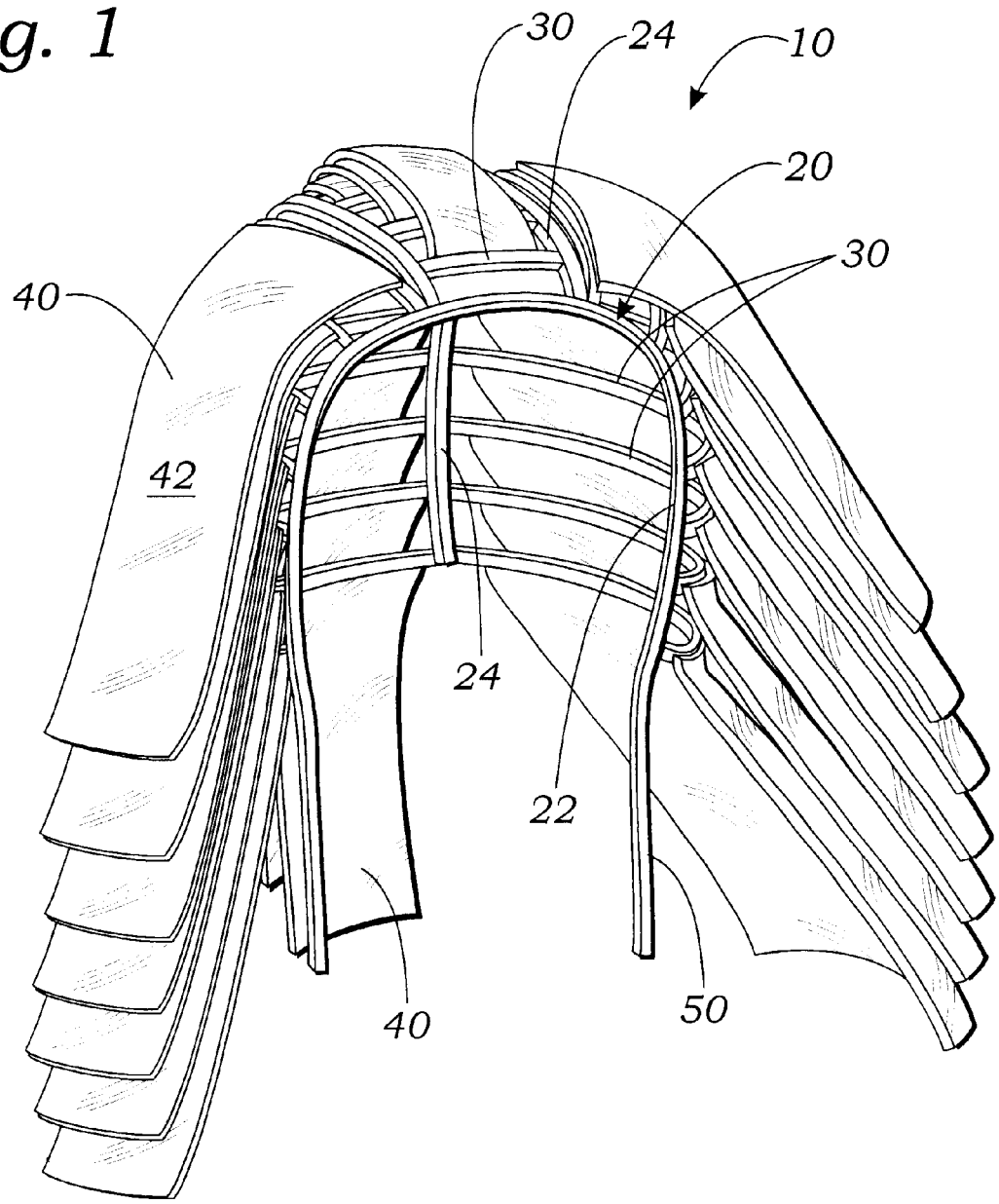
FIG. 1 is a perspective view of the preferred embodiment of the present invention.

As shown in FIG. 1, the cap 10 includes a support frame means 20 for supporting a plurality of strut members 30 in a spaced apart positions around the head of the user 11. It is important to realize that those skilled in the art can devise many structures to provide the necessary framework for the strut members 30. In the preferred embodiment, the support frame means 20 is a support frame having a front frame 22 and a pair of branches 24. The front frame 22 is shaped to extend around the face of the user 11. The pair of branches 24 each extend from the front frame 22 and are shaped to extend across the top of the head and down the back of the head of the user 11. The plurality of strut members 30 are supported in spaced apart positions by the support frame 20. The support frame 20 and the plurality of strut members 30 are constructed of a flexible material, preferably a plastic ribbon. The basic structure of the support frame 20 and the plurality of strut members 30 is similar to the hair highlighting cap disclosed in Torres, U.S. Pat. No. 5,562,111, hereby incorporated by reference.

The cap 10 further includes a plurality of wing members 40. Each of the plurality of wing members 40 is attached to one of the plurality of strut members 30 and extends therefrom to a length approximately that of the multiple strands of hair 12 to be colored. Each of the plurality of wing members 40 preferably has a width the length of the strut member 30 to which it is attached. Each of the plurality of wing members 40 is constructed of a material that is both flexible and resistant to the chemicals used to color the hair 12. Each of the plurality of wing members 40 is preferably constructed of a transparent material, most preferably a transparent plastic.

The cap 10 preferably includes a fastening means 50 for fastening the support frame 20 under a chin of the user 11. The fastening means 50 is preferably a pair of straps that extend downward from the front frame 22. The user 11 can attach the pair of straps 50 to each other, either by tying the straps 50 together or fastening them with snaps, buckles, buttons, VELCRO® or other fastening mechanisms well known in the art.

Figure 2:
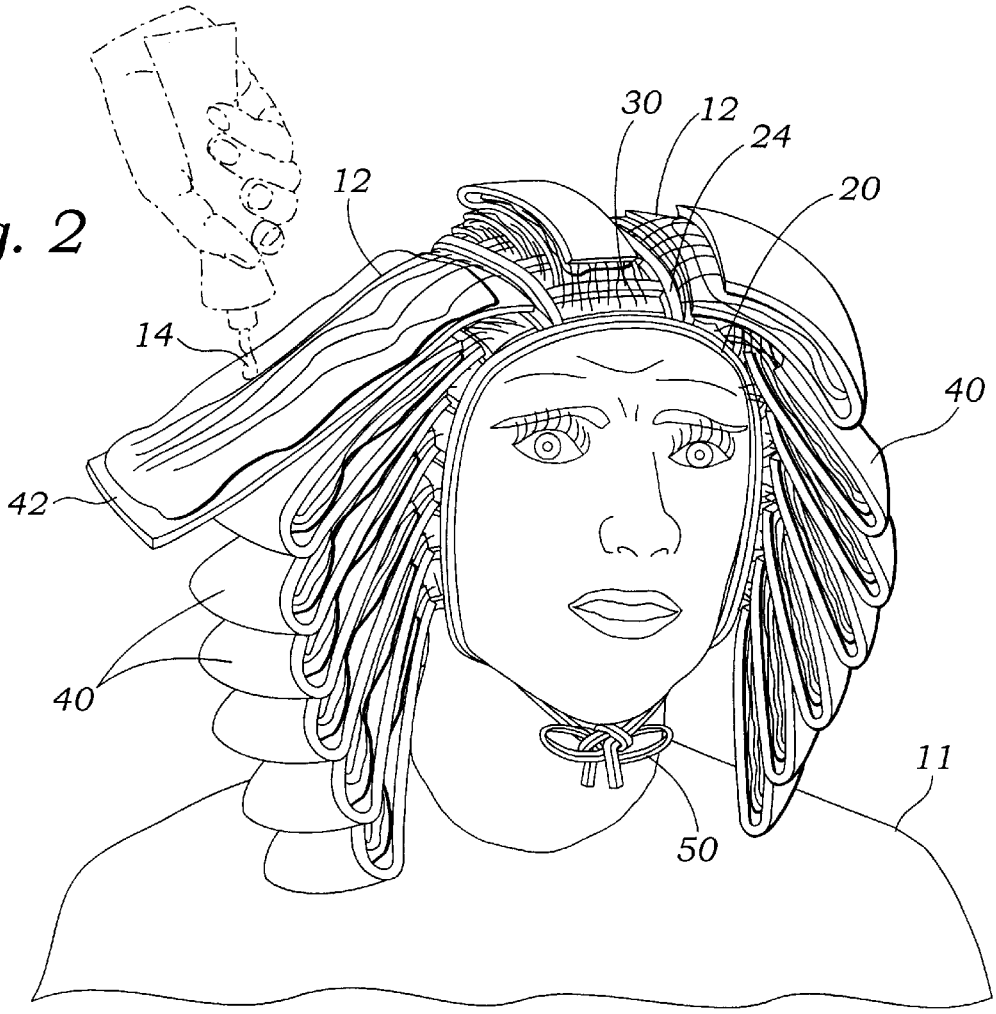
FIG. 2 is a perspective view of the cap positioned on a head of a user while a coloring agent is applied to an upper surface of one of the plurality of wing members.

As shown in FIG. 2, the invention further includes a method for coloring multiple strands of hair 12 of a user 11 the above-described cap 10. The cap 10 is positioned on a head of the user 11 such that the front frame 22 extends around the face of the user 11 and each of the pair of branches 24 extends from the front frame 22, across the top of the head of the user 11, and down the back of the head. The cap 10 is then preferably fastened under the chin of the user 11 using the fastening means 50, preferably by tying the straps 50 under the chin. In this position, the multiple strands of hair 12 to be colored are pulled between the strut members 30 so that the hair 12 is positioned on an upper surface 42 of each of the plurality of wing members 40.

Figure 3:
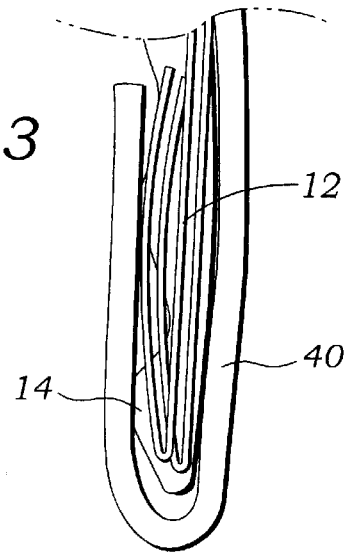
FIG. 3 is a side elevational view of one of the plurality of wing members once it has been folded around the coloring agent and multiple strands of hair to be colored.

As shown in FIGS. 2 and 3, a coloring agent 14 is applied to the upper surface 42 of one of the plurality of wing members 40. Once the one of the plurality of wing members 40 is covered with the coloring agent 14, the wing member 40 is then folded, thereby trapping the hair 12 and the coloring agent 14 within each of the plurality of wing members 40 such that the coloring agent 14 functionally coats each of the multiple strands of hair 12 to be colored. This process is repeated until all of the plurality of wing members 40 has been used and folded.

A wide variety of coloring agents 14 can be used, including bleaching-type agents to lighten the color of the hair 12, various dyes to change the hair 12 to another color, and various chemical treatments that those skilled in the art may want to selectively apply to the hair 12 of one of their clients. Folding each of the plurality of wing members 40 allows the hair 12 to be completely covered by the coloring agent 14, while protecting against unwanted transfer of the coloring agent 14.

The plurality of wing members 40 are preferably constructed of a transparent plastic so that the hair 12 can be visually inspected for any changes in color; and the coloring agent 14 can be removed once the hair 12 has reached its desired color. It is important that the coloring agent 14 be removed as soon as possible because the harsh chemicals in the coloring agent 14 can severely damage the hair 12 if left in for too long.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A method for coloring multiple strands of hair of a user, the method comprising the steps of:

a) providing a cap having the following:

a support frame means for supporting a plurality of strut members in spaced apart positions; and a plurality of wing members, each wing member being attached to one of the plurality of strut members, each wing member having a length approximately that of the multiple strands of hair to be colored;

b) positioning the cap on a head of the user such that the front frame extends around the face of the user and each of the pair of branches extends from the front frame, across the top of the head of the user, and down the back of the head;

c) pulling the multiple strands of hair to be colored between the strut members so that the hair is positioned on an upper surface of each of the plurality of wing members;

d) applying a coloring agent to the upper surface of one of the plurality of wing members, such that the coloring agent functionally coats each of the multiple strands of hair to be colored;

e) folding the one of the plurality of wing members; and f) repeating steps d and e until all of the plurality of wing members have been used and folded.

2. The method of claim 1 further comprising the step of: fastening the front frame under a chin of the user.

3. The method of claim 1 wherein the plurality of wing members are transparent.

* * * * *